US006883403B2

(12) United States Patent
Drewes

(10) Patent No.: US 6,883,403 B2
(45) Date of Patent: Apr. 26, 2005

(54) TOOL FOR FASTENING OR LOOSENING THREADED COUPLINGS FOR CABLES

(75) Inventor: Martin Drewes, Paderborn (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/679,291

(22) Filed: Oct. 7, 2003

(65) Prior Publication Data

US 2004/0079203 A1 Apr. 29, 2004

(30) Foreign Application Priority Data

Oct. 24, 2002 (DE) ..... 202 16 419 U

(51) Int. Cl.[7] ..... B25B 13/28

(52) U.S. Cl. ..... 81/99; 81/111; 81/177.1; 81/DIG. 6

(58) Field of Search ..... 81/111, 113, 117, 81/92, 97, 99, 177.1, 176.1, 176.2, 176.15, 176.3, DIG. 6, DIG. 8

(56) References Cited

U.S. PATENT DOCUMENTS 1,415,867 A * 5/1922 Coleman ..... 81/99
2,649,824 A * 8/1953 Maxwell ..... 81/99
2,700,315 A * 1/1955 Hermanson ..... 81/183
5,251,518 A * 10/1993 Woo ..... 81/99
5,261,300 A 11/1993 Willett
5,996,445 A * 12/1999 Wiens et al. ..... 81/111
6,666,113 B1 * 12/2003 Bravo ..... 81/111

FOREIGN PATENT DOCUMENTS

DE 295 04 511 6/1995
DE 196 12 756 9/1997

* cited by examiner

*Primary Examiner*—Jacob K. Ackun, Jr.
(74) *Attorney, Agent, or Firm*—Lawrence E. Laubscher, Sr.

(57) ABSTRACT

A hand tool for tightening or loosening a threaded cylindrical member relative to a corresponding threaded socket, including a generally rectangular wrench body which contains a generally circular opening for coaxially receiving the cylindrical member, a generally disk-shaped locking cam that is moveably connected with the wrench body for displacement between extended and retracted positions extending within and withdrawn from the circular opening, respectively, thereby clamping the threaded cylindrical member when the locking cam is extended into the circular opening, and a handle member operable when the cam is in the extended position to rotate the wrench body with the cylindrical member clamped thereto relative to the threaded socket.

13 Claims, 5 Drawing Sheets

2
14
19
5
H
1
19

TOOL FOR FASTENING OR LOOSENING THREADED COUPLINGS FOR CABLES

CROSS REFERENCE TO RELATED APPLICATIONS

This application claims benefit to the German Application No. 202 16 419.5 filed on Oct. 24, 2002.

BACKGROUND OF THE INVENTION

1. Field of the Invention

The invention relates to a hand tool for tightening or loosening a cable screw connector relative to a stationary threaded socket mounted on a housing.

2. Description of the Related Art

In order to screw together packaged assembly circuits with screw sleeves that have a round cross-section, a pertinent tool must meet two requirements. First, the tool must be able to be positioned laterally next to the longitudinal axis of the screw sleeve, thereby allowing the tool to apply torque to the screw sleeve. Second, the tool must be designed and constructed such that it can operate in a small area around the screw sleeve and packaged assembly circuits, because the packaged assembly circuits typically have a plurality of tightly packed screw connections that are axially parallel to each other.

BRIEF SUMMARY OF THE INVENTION

Accordingly, a primary object of the present invention is to provide a tool that can tighten and loosen cable screw connections by applying a torque within a small space, which tool includes a body containing an opening for receiving the screw connection. A cam is rotatably connected with the body for pivotable rotation between an extended and retracted position. When the cam is pivoted into the extended position, the cam extends retracted position. When the cam is pivoted into the extended position, the cam extends into the tool opening, thereby allowing the cam and the body to clamp and hold the screw connection.

A drive handle interacts with the cam to rotate the tool, thereby to rotate the screw connector relative to the socket of the assembly circuit. The drive handle connects to the tool in a lateral, position parallel to the vertical axis of rotation of the screw connection, thereby allowing the tool to be rotated in a small space. This allows the tool to tighten or loosen various screw connectors that are in close proximity to one another on the assembly circuit.

The tool has a simple structure and is comprised of a relatively small number of parts.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
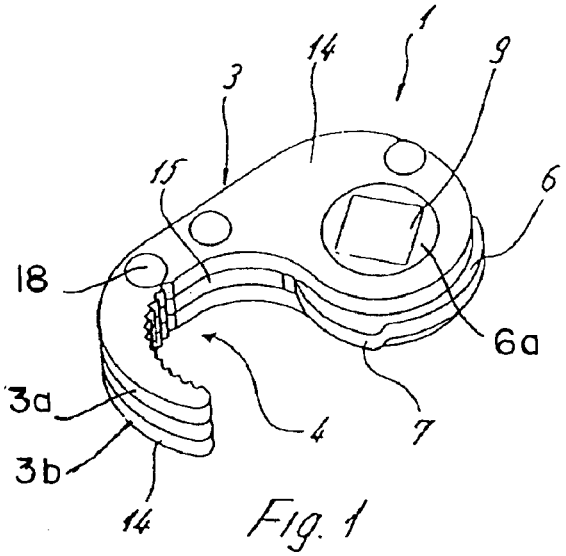
FIG. 1 is a perspective view of the tool body and locking cam.
Figure 2:
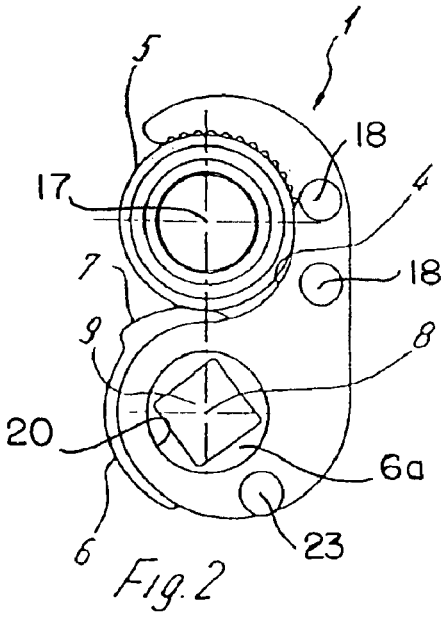
FIG. 2 is a top view to the tool with the cam in an extended position in clamping relation relative to a screw connector.
Figure 3:
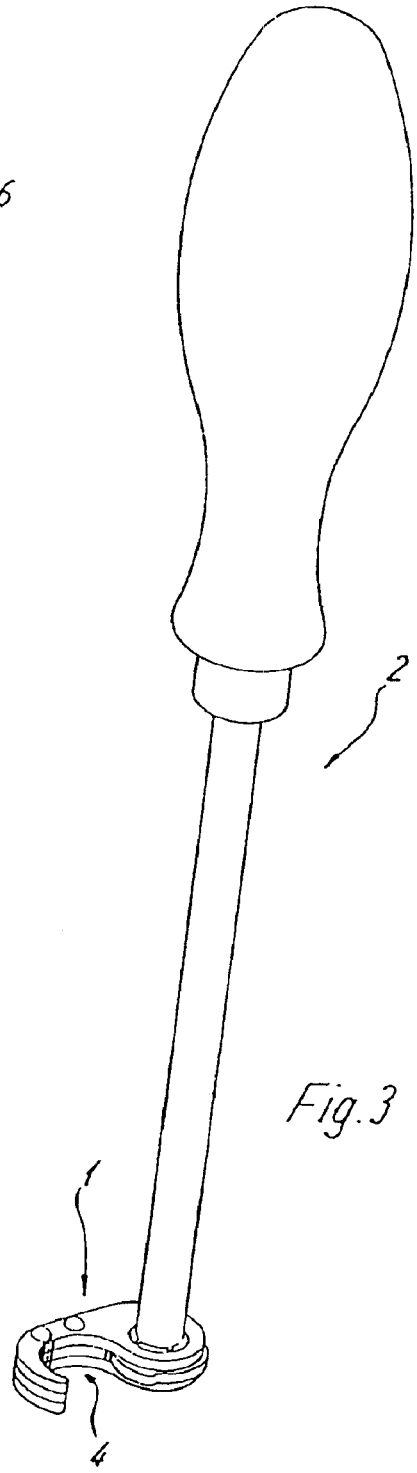
FIG. 3 is a perspective view of the tool with the drive handle in the attached position.

Referring first more particularly to FIGS. 1–3, the tool of the present invention includes a wrench body 1 having a generally rectangular configuration and containing a generally circular opening 4 for coaxially receiving the screw-threaded cylindrical member 5, as best shown in FIG. 2. As will be described in greater detail below, a handle 2 is removably connected with the tool body 1 for rotating the tool body with the cylindrical member 5 clamped thereto about the axis 17 of the opening 4. A locking cam 6 is rotatably connected with the wrench body 1 for displacement between extended and retracted positions extending into and withdrawn from the opening 4, respectively. Thus, the cam member 6 is provided with an eccentric locking portion 7 that is adapted to engage the cylindrical member 5, as shown in FIG. 2 when the locking cam is in the extended position.

The body member 1 includes a pair of parallel spaced side plates 3*a* and 3*b* that are arranged on opposite sides of a spacer plate 15. The side plates 3*a* and 3*b* are rigidly fastened to the spacer plate 15 by rivets 18, or the like. The locking cam 6 has a generally disc-shaped configuration and includes on opposite sides thereof a pair of cylindrical collar portions 6*a* and 6*b* that are journaled in corresponding circular openings 20 defined in the side plates 3*a* and 3*b*. The cam member 6, which rotates about the axis 8 shown in FIG. 2, contains a through bore 9 having a non-circular cross sectional configuration, which through bore removably receives the corresponding non-circular end 10 of the handle 2, as will be described in greater detail below.

Figure 4:
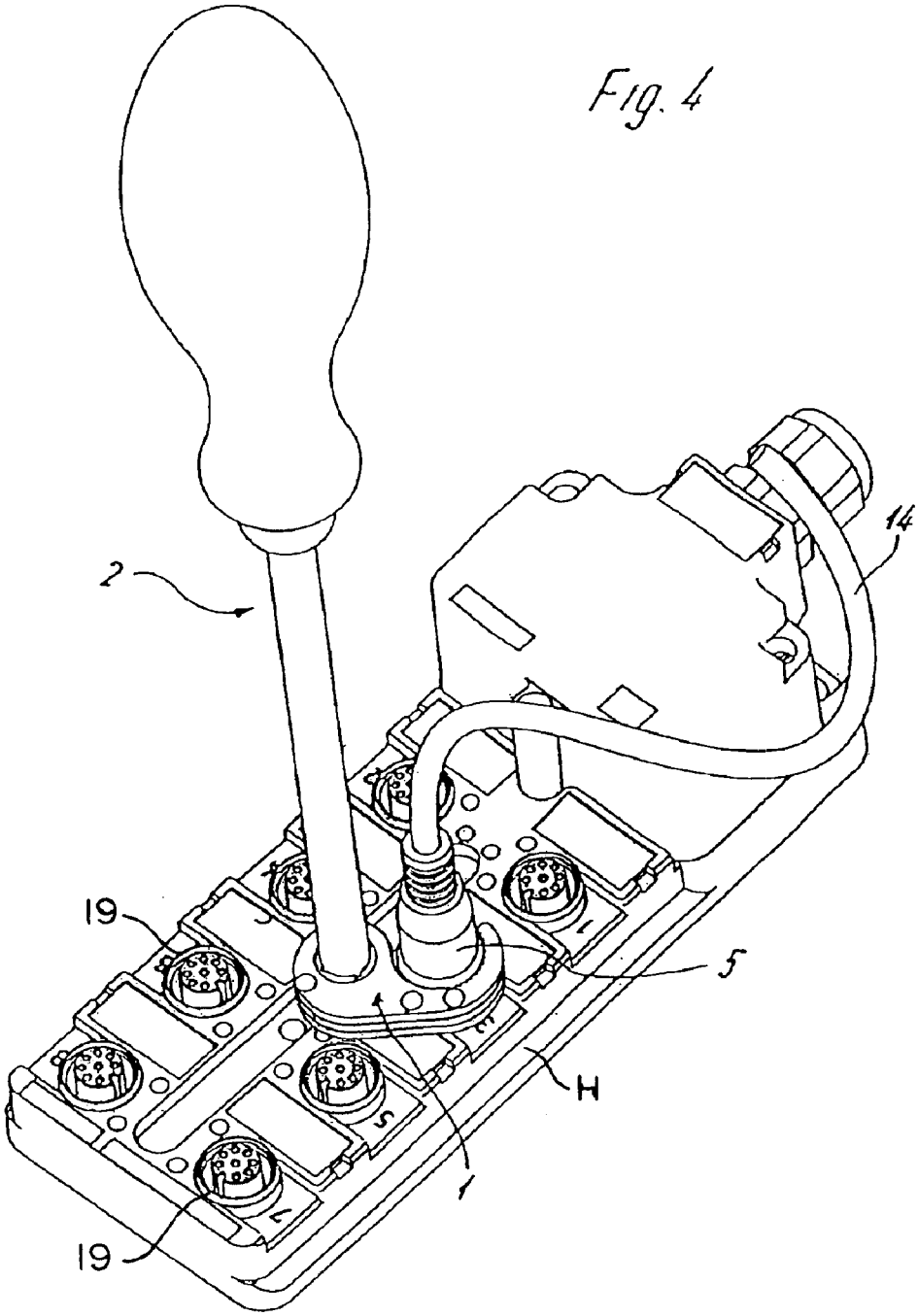
FIG. 4 is a perspective view illustrating the use of the tool with the assembly circuit.

Referring now to FIG. 4, the tool of the present invention is operable to rotate the threaded member 5 relative to a correspondingly threaded socket 19 mounted on the housing H of the electrical system. The cable 14 is connected with the cylindrical member 5 for supplying signals to and from electrical circuits contained within the housing H. The tool is operable to rotate the threaded member 5 relative to the corresponding socket 19, the rotation occurring in a first direction about the vertical axis 17 that is centrally located within the opening 4.

Figure 5:
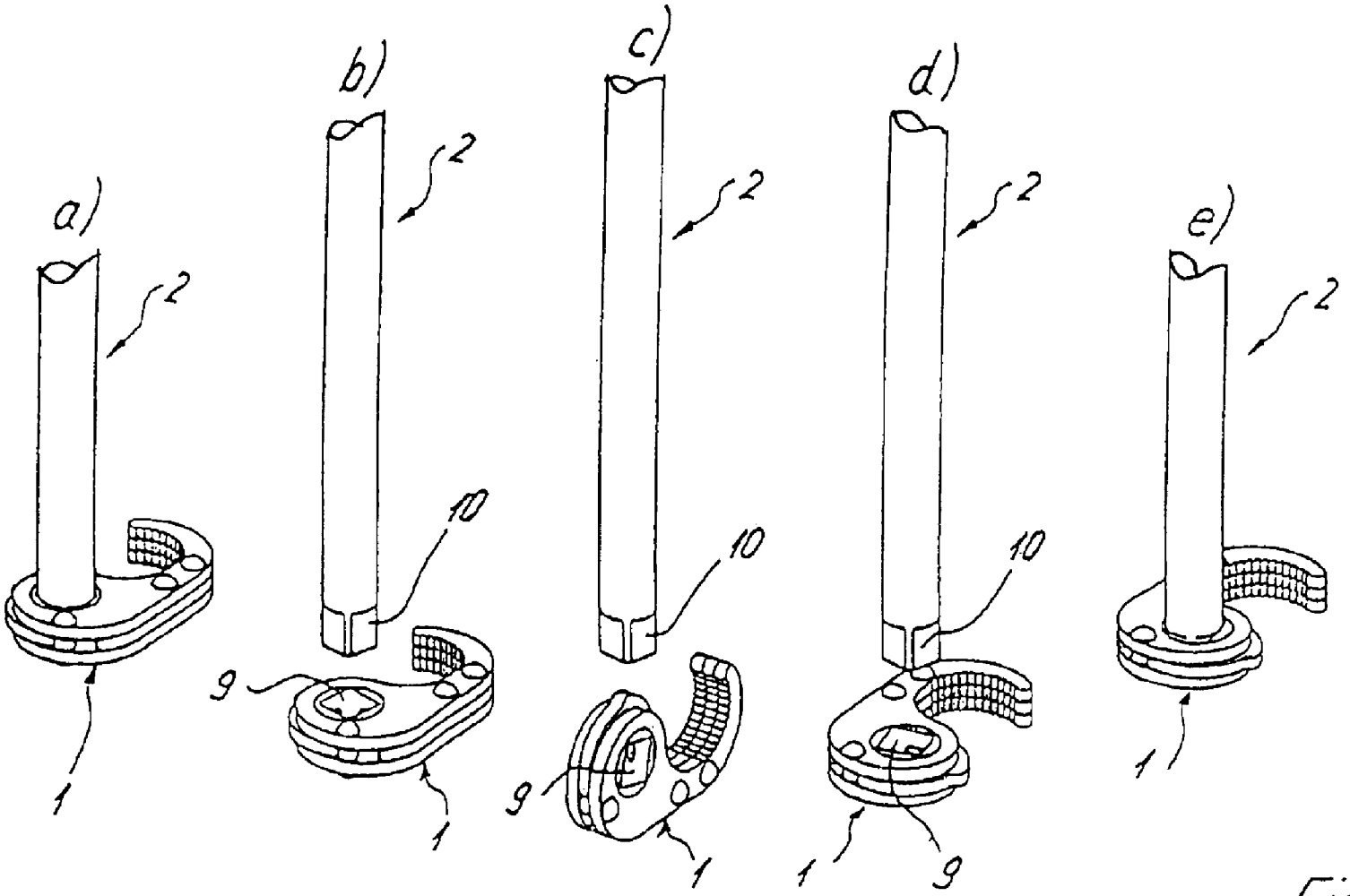
FIG. 5 includes perspective views of the tool illustrating the transition of the tool from a tightening operation to a loosening operation.

Referring now to FIG. 5, in order to rotate the threaded member 5 in the opposite direction relative to the socket 19, the handle 2 is removed from the wrench body 1 as shown in FIG. 5(*b*), whereupon the wrench body 1 is rotated through 180° about its longitudinal axis , as shown in FIGS. 5*c* and 5*d*. The non-circular end 10 of the drive handle 2 is then reinserted into the other end of the through bore 9, whereupon the handle 2 is rotated to displace the threaded member 5 in the opposite direction relative to its corresponding socket 19. Thus, the through bore 9 has a uniform non-circular configuration throughout its length, thereby to receive at either end the non-circular handle portion 10 of the operating handle 2.

Figure 6:
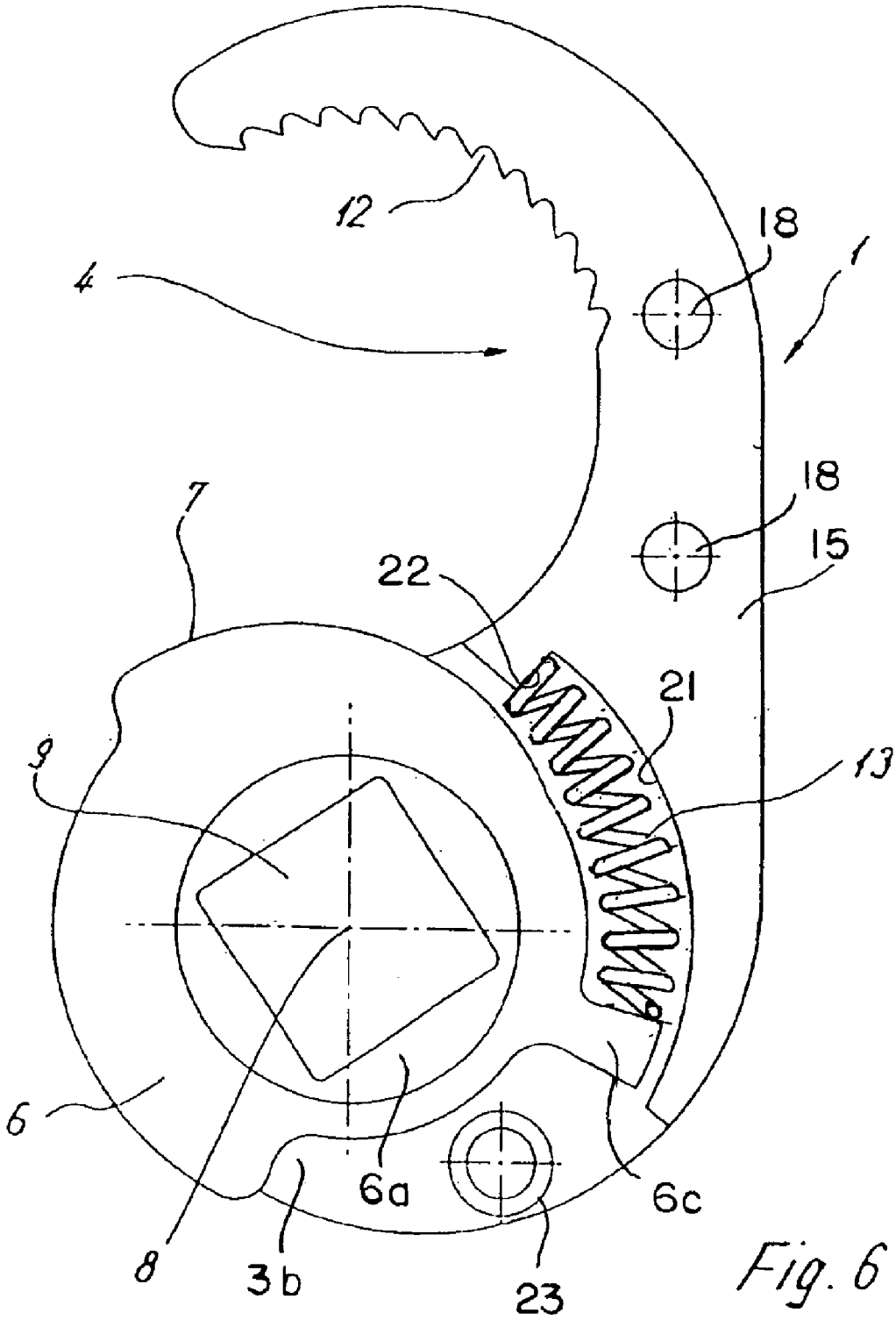
FIG. 6 is a longitudinal view of a first embodiment of the tool with certain parts removed.
Figure 7:
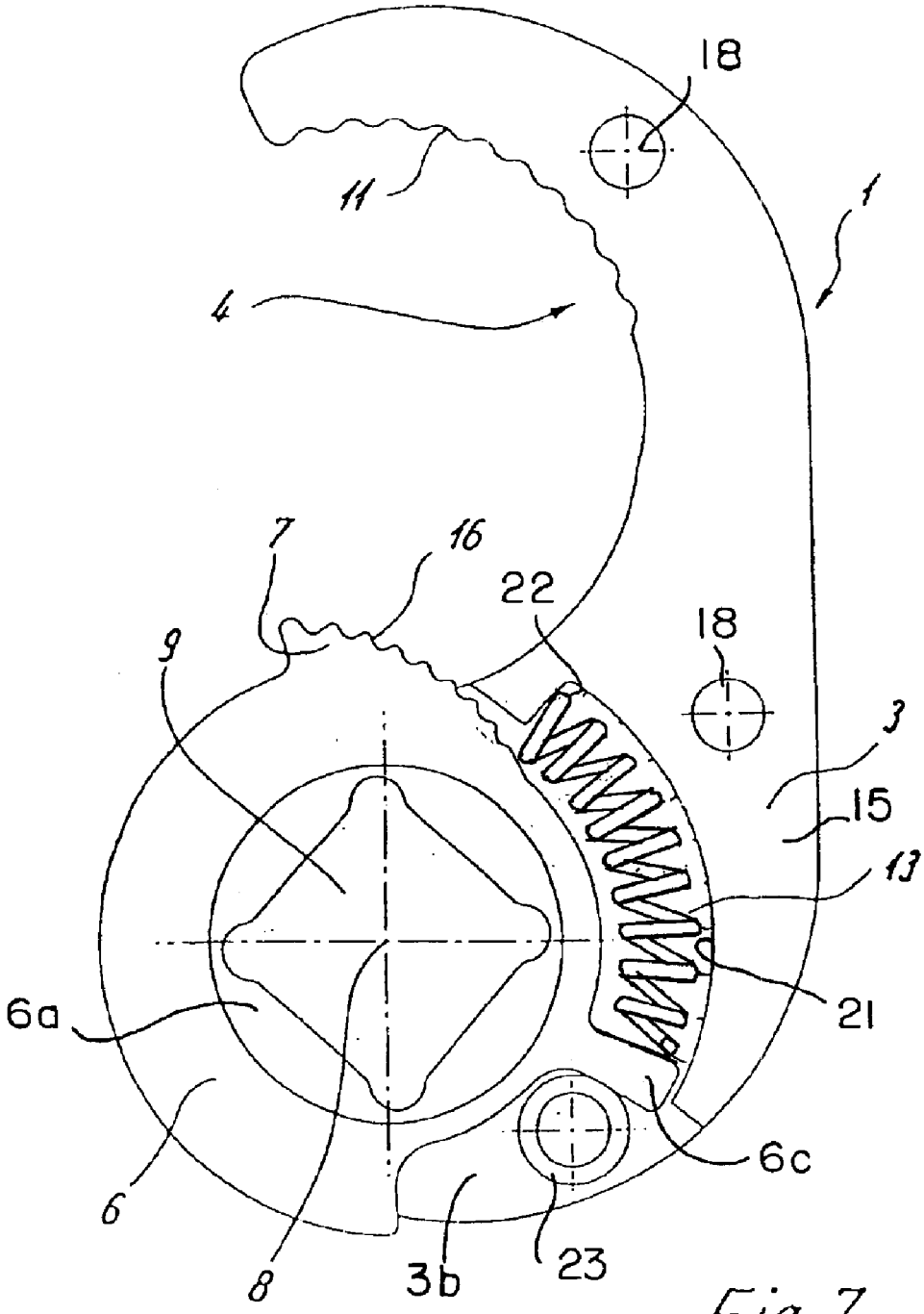
FIG. 7 is a view of a second embodiment of the tool with certain parts removed.

Referring to FIG. 6, the first embodiment of the tool is illustrated with the upper side plate 3*a* removed, thereby to expose the compression spring 13 which reacts between a shoulder 22 defined at one end of the channel 21 contained within the spacer plate 15, and at the other end with a radially projecting tab portion 6*c* carried by the locking cam 6. The spring 13 thus functions to bias the cam in the clockwise direction in FIG. 6 relative to the wrench body 1, there to cause the eccentric cam locking portion 7 to extend within the circular opening 4. In this embodiment, serrations 12 are provided on the wall surface of the body opening 4, thereby to firmly grip or clamp the threaded cylindrical member 5 to the wrench body 1. A fixed stop 23 cooperates with the radial tab portion 6*c* to limit the extent of travel of the cam 6 in the clockwise locking direction. In the modification of FIG. 7, the clamping surface of the opening 4 may be provided with grooves 11, and the clamping surface of the cam locking portion 7 can be provided with the grooves 16, thereby to more firmly clamp the tool body 1 to the screw threaded member 5. When the non-circular end 10 of the handle 2 is inserted within the corresponding through bore 9 contained in the locking cam 6, the handle may be rotated to displace the screw threaded cylindrical member 5 about its axis 17, the cam 6 being supported by the cooperation between the radial tab 6*c* and the stationary stop member 23 connected between the upper side plate 3*a* and the lower side plate 3*b*.

Thus, when the tool body 1 has a first orientation, the handle 2 may be rotated to tighten the threaded member 5 relative to its corresponding socket 19. To loosen the threaded member 5, the handle is removed from the through bore 9, the tool body is rotated through an angle of 180° about its longitudinal axis, and the handle is reinserted within the through-bore opening 9, whereupon the handle and the tool body are rotated in the opposite direction to unfasten the threaded member 5 from its socket 19.

The tool of the present invention offers the advantage that the threaded member 5 may be fastened or unfastened relative to the socket 19 in a relatively small limited space on the assembly, without disturbing the cable 14 or interfering with the other screw members and their associated sockets 19. Since the drive tool 2 extends vertically, the wrench body 1 may be rotated in a very limited space.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A hand tool for tightening and loosening a threaded cylindrical first member (5) relative to a corresponding threaded socket (19), comprising:

(a) a generally rectangular wrench body (1) containing a generally circular opening (4) for coaxially receiving the first member;

(b) a generally disk-shaped locking cam (6) moveably connected with said body for displacement between extended and retracted positions extending within and withdrawn from said opening, respectively, the surfaces of said cam and said opening being operable to grip the outer periphery of the first member when said cam is in said extended position, thereby to clamp said wrench body to the first member; and (c) handle means (2) operable when said locking cam is in said extended position for rotating said wrench body about the axis of said opening, thereby to rotate the first member in a first direction relative to the socket.

2. A hand tool as defined in claim 1, and further including:

(d) spring means (13) biasing said cam member toward said locking position.

3. A hand tool as defined in claim 2, wherein said body opening is a through opening, and wherein said locking cam contains a through bore (9); and further wherein said handle means includes a handle removably inserted at one end within said cam through bore, said through bore and said handle means having corresponding non-circular cross-sectional configurations, whereby upon removal of said handle from said cam through bore and rotation of said wrench body about its longitudinal axis through an angle of 180 degrees, said handle may be reinserted in said through bore to rotate the first member in the opposite direction relative to the socket.

4. A hand tool as defined in claim 3, wherein said through bore and said handle means have square cross-sectional configurations.

5. A hand tool as defined in claim 4, wherein said through bore has a cross-sectional dimension of about ¼ inch.

6. A hand tool as defined in claim 3, wherein said locking cam has an eccentric locking portion (7) that extends into said body opening when said locking cam is in said extended position.

7. A hand tool as defined in claim 6, wherein at least one of the locking surfaces (16) of said cam eccentric locking portion and said body opening is grooved.

8. A hand tool as defined in claim 6, wherein at least one of the locking surfaces (12, 16) of said cam eccentric locking portion and said opening is serrated.

9. A hand tool as defined in claim 1, wherein said wrench body includes:

(1) a pair of parallel spaced side plates (3*a*, 3*b*);

(2) spacer means (15) arranged between said side plates; and (3) connecting means rigidly connecting together said side plates and said spacer means.

10. A hand tool as defined in claim 9, wherein said locking cam includes on opposite sides thereof a pair of integral cylindrical collar portions (6*a*, 6*b*) journaled in corresponding circular openings (20*a*, 20*b*) contained in said side plates, respectively.

11. A hand tool as defined in claim 10, and further including:

(e) stop means for limiting the displacement of said locking cam between said extended and said retracted positions, respectively.

12. A hand tool as defined in claim 11, wherein said stop means comprises:

(1) a cam radial portion (6*c*) that extends radially outwardly from said locking cam; and (2) a stationary stop (23) carried by said wrench body for engagement by said cam radial portion when said locking cam is in said locking position.

13. A hand tool as defined in claim 12, wherein said spring means comprises a compression spring arranged on the opposite side of said cam radial portion from said stationary stop, said compression spring having a first end in engagement with said cam radial portion, and a second end in engagement with a stationary abutment surface (22) carried by said wrench body.

* * * * *